US010344553B2

(12) United States Patent
Allen et al.

(10) Patent No.: US 10,344,553 B2
(45) Date of Patent: Jul. 9, 2019

(54) WELLBORE COMPLETION APPARATUS AND METHODS UTILIZING EXPANDABLE INVERTED SEALS

(71) Applicants: Jason A. Allen, Houston, TX (US); Robert S. O'Brien, Katy, TX (US)

(72) Inventors: Jason A. Allen, Houston, TX (US); Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 258 days.

(21) Appl. No.: 15/289,430

(22) Filed: Oct. 10, 2016

(65) Prior Publication Data

US 2018/0100370 A1 Apr. 12, 2018

(51) Int. Cl.

| | |
|---|---|
| ***E21B 33/12*** | (2006.01) |
| ***E21B 43/10*** | (2006.01) |
| *E21B 34/06* | (2006.01) |
| *E21B 43/08* | (2006.01) |
| *E21B 33/00* | (2006.01) |

(52) U.S. Cl.

CPC ..... *E21B 33/12* (2013.01); *E21B 43/103* (2013.01); *E21B 34/06* (2013.01); *E21B 43/08* (2013.01); *E21B 2033/005* (2013.01)

(58) Field of Classification Search

CPC .... E21B 2033/005; E21B 33/12; E21B 34/06; E21B 43/08; E21B 43/103

USPC ..... 285/3, 4, 15, 370

See application file for complete search history.

(56) References Cited

U.S. PATENT DOCUMENTS

| | | | | |
|---|---|---|---|---|
| 1,797,177 | A | 3/1931 | Nixon et al. | |
| 5,584,488 | A | 12/1996 | Lembcke | |
| 6,241,013 | B1 | 6/2001 | Martin | |
| 6,565,093 | B2 | 5/2003 | Crow et al. | |
| 6,830,104 | B2 | 12/2004 | Nguyen et al. | |
| 6,843,480 | B2 | 1/2005 | Nelson et al. | |
| 7,448,445 | B2 | 11/2008 | Doane et al. | |
| 2003/0151249 | A1* | 8/2003 | Topf, Jr. | F16L 21/002 285/55 |
| 2005/0155772 | A1 | 7/2005 | Dusterhoft et al. | |
| 2007/0163781 | A1 | 7/2007 | Walker | |
| 2012/0118573 | A1 | 5/2012 | Richard et al. | |
| 2012/0248703 | A1* | 10/2012 | Kocurek | E21B 33/03 277/343 |

(Continued)

OTHER PUBLICATIONS

Weatherford, [online]; [retrieved on Jan. 11, 2012]; retrieved from the internet http://www.weatherford.com/weatherford/groups/web/documents/weatherfordcorp/WFT071942.pdf, "Model WFX Cross-over Tool," 2 Pages.

(Continued)

*Primary Examiner* — Caroline N Butcher

(74) *Attorney, Agent, or Firm* — Cantor Colburn LLP

(57) ABSTRACT

An apparatus for use in a wellbore is disclosed that in one non-limiting embodiment includes a housing including a first location having a first inside dimension and a second location having a second inside dimension that is larger than the first inside dimension, and a seal assembly placed with a sliding fit at the first location, wherein the seal assembly includes a seal body and an inverted seal along an inside of the seal body and wherein the seal assembly is movable from the first location to the second location and expandable into the second location when the seal assembly is positioned at the second location.

20 Claims, 4 Drawing Sheets

(56) References Cited

U.S. PATENT DOCUMENTS

| | | | | |
|---|---|---|---|---|
| 2013/0140041 | A1* | 6/2013 | Allen | E21B 23/06 166/387 |
| 2015/0075807 | A1* | 3/2015 | Allen | E21B 43/14 166/373 |
| 2016/0010429 | A1 | 1/2016 | Getzlaf et al. | |

OTHER PUBLICATIONS

PCT International Search Report and Written Opinion; International Application No. PCT/US2017/052186; International Filing Date: Sep. 19, 2017; dated Feb. 1, 2018, 14 pages.

* cited by examiner

WELLBORE COMPLETION APPARATUS AND METHODS UTILIZING EXPANDABLE INVERTED SEALS

BACKGROUND

1. Field of the Disclosure

This disclosure relates generally to apparatus and methods for completion of wellbores for producing hydrocarbons from subsurface formations.

2. Background of the Related Art

Wellbores are formed in subsurface formations for the production of hydrocarbons (oil and gas). Modern wells can extend to great well depths, often more than 1500 meters. Hydrocarbons are found in various traps in the subsurface formations at different depths. Such sections of the formation are referred to as reservoirs or hydrocarbon-bearing formations or zones. Most zones are generally permeable, allowing the formation fluid to flow from the zones into the wellbore due to the pressure differential between the formation zones and inside of the wellbore. In case of low permeable zones, a slurry (mixture of water, sand and additives) is supplied to such zones to fracture the rock to facilitate the flow of the formation fluid into the wellbore. Such a method is generally referred to as fracturing or fracking. Fracturing requires deployment of a string with a variety of equipment to supply the slurry to selected zones. The wellbore is typically lined with a cemented casing perforated along the production zones to allow the formation fluid to flow to inside the casing. A completed string is installed to transport the formation fluid from these selected zones to the surface. The strings utilized for fracturing and for the production of hydrocarbon incorporate a variety of equipment, including packers, valves and seals. Completion strings also utilize sand screens that prevent solid particles above a certain size from flowing from the production zones into the completion assemblies. Gravel is typically packed between the sand screen and the casing. Seals are commonly utilized to isolate certain sections between strings during the completion process, including fracking and gravel packing. Such strings utilize tubular members and seals. Inverted seals are considered advantageous in gravel packing and fracturing operations because they allow a cross-over tool string to act as a continuous sealing mandrel with minimum locations where such a tool can jam around locations where inverted seals are placed. Inverted seals currently used, however, tend to sustain damage from proppant in the slurry flowing therethrough, temperature cycling and passages of various tools through such seals, especially the passages of shifting tool and locating tools that commonly use collets during subsequent completion operations. Also, well operators have historically not favored inverted seals because damaged inverted seals cannot be replaced during the production life of the well. It is therefore desirable to provide inverted seals that address at least some of the problems with currently used inverted seals.

The disclosure herein provides inverted seals for use in strings that can be expanded permanently or temporarily to allow larger internal dimensions for subsequent operations and installation of new seals in case such seals are damaged during the life of the production well.

SUMMARY

In one aspect, an apparatus for use in a wellbore is disclosed that, in one non-limiting embodiment includes a housing including a first location having a first inside dimension and a second location having a second inside dimension that is larger than the first inside dimension, and a seal assembly placed with a sliding fit at the first location, wherein the seal assembly includes a seal body and an inverted seal along an inside of the seal body and wherein the seal assembly is movable from the first location to the second location and expandable into the second location when the seal assembly is positioned at the second location.

In another aspect, a method of performing an operation in wellbore is disclosed that one non-limiting embodiment includes conveying a string in the wellbore that includes a housing that includes a first location having a first inside dimension and a second location having a second inside dimension that is greater than the first inside dimension; a seal assembly with a sliding fit at the first location inside the housing, wherein the seal assembly includes a seal body and an inverted seal along an inside of the seal body and wherein the seal assembly is movable from the first location to the second location and expandable into the second location; performing a selected operation in the wellbore with the seal assembly at the first location; and moving the seal assembly from the first location to the second location after performing the selected operation.

Examples of the more important features of a well system including one or more flexible inverted seals have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are sometimes given same numerals and wherein.

DETAILED DESCRIPTION OF THE DRAWINGS

Figure 1:
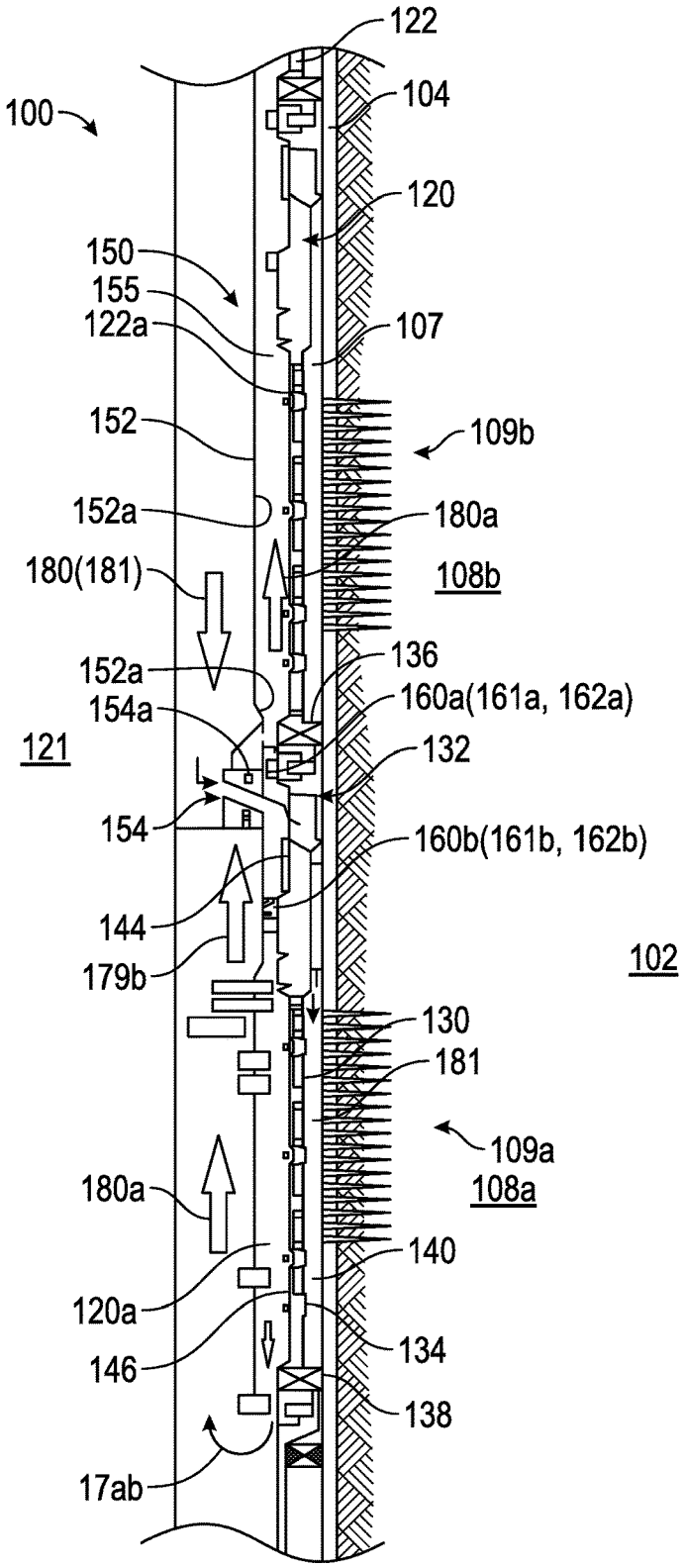
FIG. 1 shows an exemplary wellbore with a completion assembly therein that includes one or more expandable inverted seals according to one non-limiting embodiment of the disclosure.

FIG. 1 is a line diagram of a section of a wellbore system 100 that is shown to include a wellbore 101 formed in formation 102 for performing a treatment operation therein, such as gravel packing. The wellbore 101 is lined with a casing 104, such as a string of jointed metal pipes sections, known in the art. The space or annulus 103 between the casing 104 and the wellbore 101 is filled with cement 106.

The system 100 described herein may be configured to perform other operations, including, but not limited to, fracturing and production operations. The system 100 is shown to include two exemplary production zones 108*a* and 108*b* from which hydrocarbons are desired to be produced. The wellbore 101 includes an outer string 120 placed inside the casing 104 with an annulus 107 therebetween. The outer string 120 includes a tubular (pipe or housing) 122 that carries a sand screens 130 and 131 for respectively allowing fluid 109*a* and 109*b* from the formation zone 108*a* and 108*b* to flow to the inside 120*a* of the outer string 120. For ease of explanation, the operations of the system 100 are described only with respect to zone 108*a*. Packers 136 and 138, respectively above and below the screen 130, are provided to isolate a spacing or annulus 140 between the casing 104 and the outer string 120 proximate to the screen 130. A port 132 above the screen 130 and a port 134 below the screen are placed to flow fluids between the annulus 140 the inside 121 of the outer string 120. A valve, such as sliding sleeve valve 144, is provided to open and close port 132 and a similar valve 146 is provided for port 134. The outer string 120 further includes an expandable inverted seal 160*a* above port 132 and an expandable inverted seal 160*b* below port 134. Seal 160*a* includes a seal body 161*a* having one or more seal members, such as o-rings 162*a*, along the inside of the seal body 161*a*. Similarly, seal 162*b* includes a seal body 161*b* having one or more seal members, such as O-rings 162*b*, along the inside of the seal body 161*b*. Seal members 162*a* and 162*b* are partially embedded in grooves made on the inside their respective seal bodies 161*a* and 161*b* and protrude or extend to the inside 120*a* of the outer string 120. To perform an operation, such as gravel packing in the annulus 140 or fracturing zone 108*a*, packers 136 and 138 are activated or set to isolate the annulus 140, while the ports 132 and 134 are open, as shown in FIG. 1. An inner string 150 (also referred to as the service string) is then conveyed or run inside the outer string 120. The inner string 150 includes a tubular 152 that carries a cross-over port 154 that is aligned with the port 132. The outer surface 152*a* of the tubular 152 seals against the seals 160*a* and 160*b* to isolate port 132 from fluid communication with the annulus 155 between the inner string 150 and the outer string 120. A slurry 180 containing a proppant 181 (such as sand) is pumped into the inner string 150, which flows into the annulus 140 via ports 154 and 132. The proppant 181 packs into the annulus 140 and the water 180*a* in the slurry returns to the surface via port 134, a flow path 154*a* in the cross-over port 154 and annulus 155 between the outer string 120 and casing 104 above the seal 160*a*. Once the gravel packing is completed, a variety of other completion functions are performed, such as installing production strings. To perform subsequent operations, the inner string 150 is pulled out of the outer string 120. In the present disclosure, the seals 160*a* and 160*b* are expandable inverted seals, which in one configuration or embodiment may be permanently expandable seals. If permanently expandable inverted seals are utilized, such seals once expanded remain expanded, as described in references to FIGS. 2B-2C, to provide larger inner space inside the outer string 120 compared to its initial or run-in position. If temporarily expandable inverted seals are utilized, such seals expand when a tool is passed or pushed through the seals and return to their initial or run-in position when the tool has passed through the seals. In either case, the seal elements 162*a* and 162*b* expand radially outward to provide larger inner space to convey other tools through the seals 160*a* and 160*b* as descried in more detail in reference to FIGS. 2A-2C. Since seals described herein can be moved radially outward, new seals having same internal dimensions can be installed below such seals, if needed, during the completion process and during the production life of the well 101.

Figures 2A, 2B, 2C:
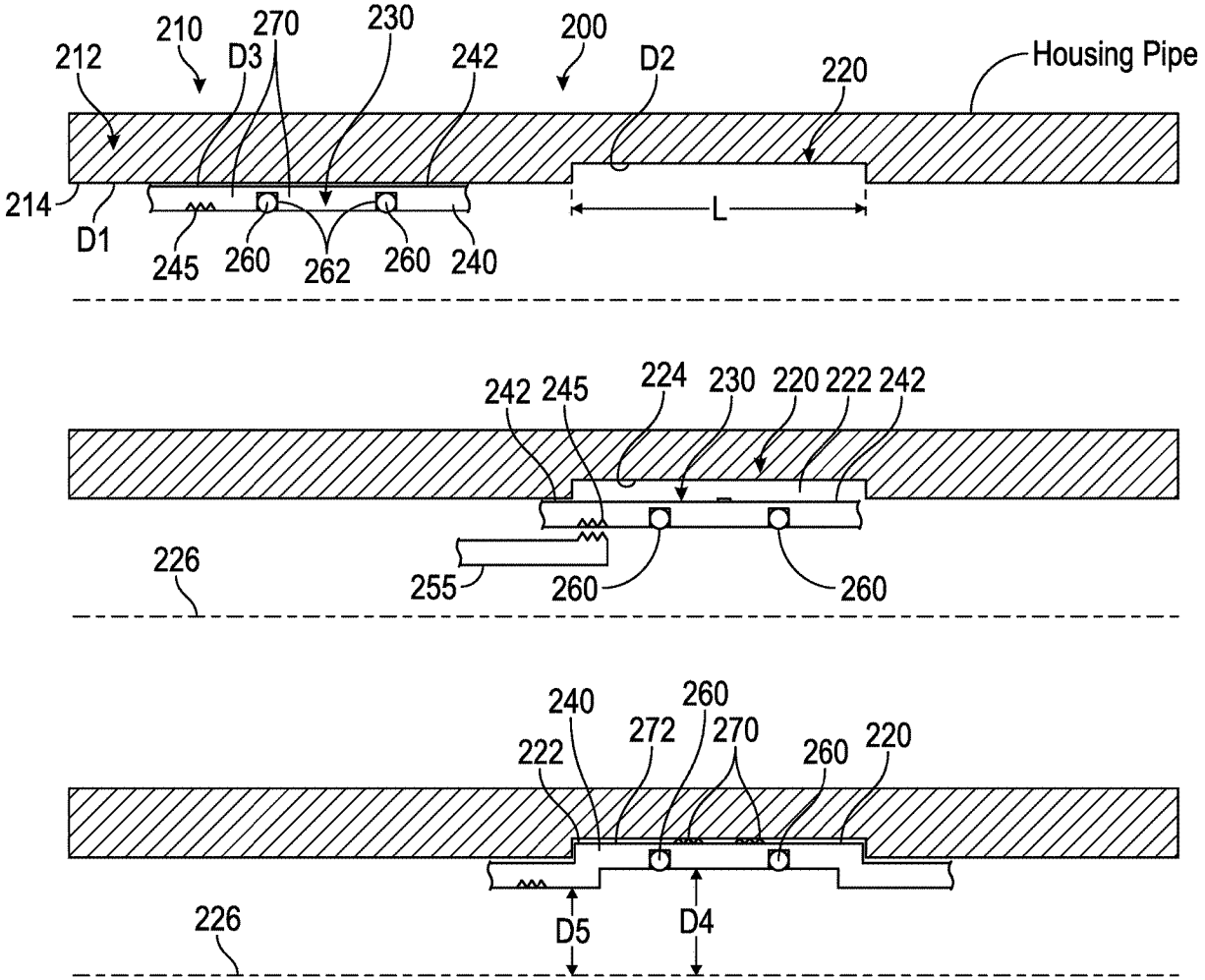
FIGS. 2A-2C show line diagrams of an expandable inverted seal during an initial state and an expansion state in a wellbore.

FIGS. 2A-2C are line diagrams showing a sequence of operations for an expandable seal 260, made according to a non-limiting embodiment of the disclosure, during a wellbore operation. FIG. 2A show a string 200 for placement in a wellbore that includes a housing or pipe section 210 that generally has an inside dimension or diameter or diameter "$D_1$". The housing 210 further includes a section 220 (also referred to as the expandable section or expandable location) of a selected length "L" that has an inside dimension or diameter $D_2$ that is larger than dimension $D_1$. An inverted seal 230, made according to one non-limiting embodiment, is placed in a sealing fashion inside the housing 210. The seal 230 includes a seal body 240 that has an outer surface 242 with the outside dimensions $D_3$ such that the seal body 240 may be placed inside the housing 210 at an initial or run-in location 212 that is spaced from expandable section 220 in a sealingly movable fashion. In such a configuration, the outer surface 242 of the seal body 240 and the inner surface 214 of the housing 210 mate with friction such that the seal body 240 remains in its initial position at location 212 until a selected force (for example, above a certain amount or threshold) is applied to the seal 230 or the seal body 240 to move it from its initial location 212 to the expandable location 220. In some embodiments, the seal 230 includes a shifting profile 245 to which a suitable shifting tool (not shown) may be engaged to move the seal body 240 from the initial location 212 to the expandable location 220. The seal body 240 includes one or more inverted seal members 260 in their respective grooves inside the seal body 240.

Referring to FIG. 2B, after one or more operations have been performed using the string 200 in the wellbore with the seal 230 in its initial position (FIG. 2A), the seal 230 may be moved to the expansion position 220 by engaging a shifting tool 255 with the shifting profile 245 and applying a selected force onto the seal 230. The seal body 240 is moved to the expansion location 220 such that a weak section 270 of the seal on the outside of seal elements 260 is are within the expansion location 220, as shown in FIG. 2B. In this position, an expansion space or gap 222 exists between the weak section 270 on the outer surface 242 of the seal body 240 and the inside 224 of the expansion section 220 that is sufficient to radially expand the seal body 240 outward to provide an inner dimension at the expansion space 220 at least equal dimension $D_1$, as described in reference to FIG. 2C.

FIG. 2C shows the seal body 240 permanently expanded about the weak location 270 into the expansion space 220 to provide an internal dimension $D_4$ about the inside 244 of the seal body 240 that is at least as large as the inner dimension $D_5$ of the seal body 240 prior to the expansion of the seal body 240. The expansion of the seal body 240 radially pushes the seal elements 260 away from the axis 226 of the housing 210 that is sufficient to allow tools of dimensions greater than the inner dimension around the seal elements 260 to pass through the seal body 240. The seal body 240 may be expanded by any suitable tool, including, but not limited to a swaging tool. Such a tool may be suitably located inside the seal body 240 about the weak location 270 and then activated to expand the seal body 240 from the inside to cause it to expand into the space 220. In one embodiment the seal body 240, at least along the seals and the weak location 270, is made from a material (such as steel) that is flexible enough but will break about the weak location and cause the seal body 240 to permanently expand into the expansion space 220 as shown in FIG. 2C. Alternatively, the seal body 240 around the seal elements 260 may be made from a malleable material, such as malleable steel, so that when the seal body 240 is expanded around the seal elements 260, the seal body 240 temporarily expands into the space 222, allowing a tool of dimensions at least equal to the dimension $D_5$ to pass through the seal 230. This may be accomplished by pushing a tool through the inside of the seal 230 with sufficient force to cause the weak section 270 along with the seal elements to radially move outward into the expansion space 220 to allow such a tool to pass through the seal 230. Such a seal will retract to its original or substantially original position when the expansion force is removed.

Figure 3A:
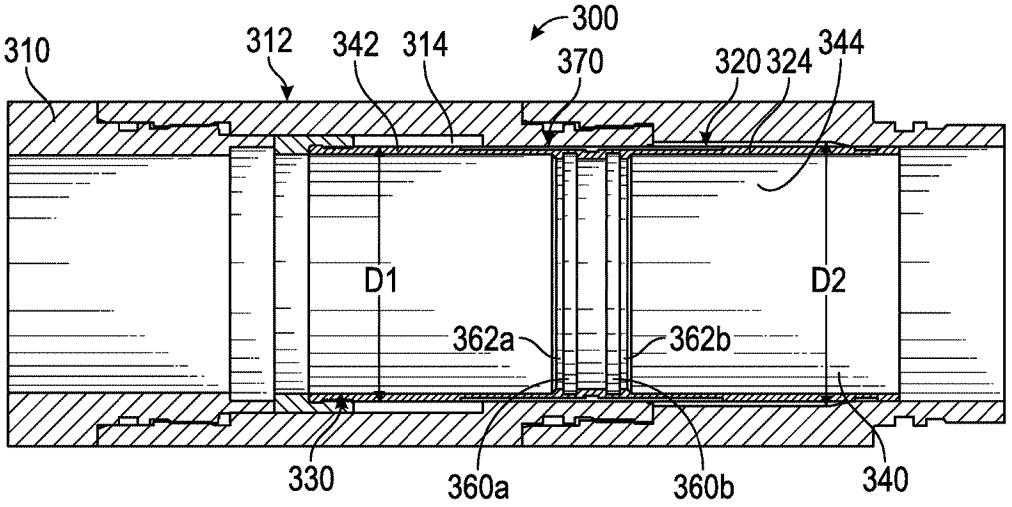
FIG. 3A is an isometric section view of a flexible seal placed at an initial or run-in location in a housing or string in a wellbore where the seal is not expandable.

FIG. 3A is an isometric section view of a portion of a string 300 that includes an expandable inverted seal 330 placed at an initial or run-in location 312 in a housing 310 in the string 300 where the seal 330 is not expandable. The seal 330 includes a seal body 340 and one or more inverted seals, such as seal elements 360*a* and 360*b*, placed in their respective grooves 362*a* and 362*b* along the inside 344 of the seal body 340. In this position, the outer surface 342 of the seal body 340 is in sealing contact with the inner surface 314 of the housing 310. In this position, the seal body 340 can be moved by applying an axial force onto the seal 330 or the seal body 340 above a selected value or threshold as described above in reference to FIGS. 2A-2C. The housing 310 includes an expandable section 320 spaced from the initial or non-expandable section 312 having an internal dimension or diameter $D_2$ that is larger than the internal diameter $D_1$ at the initial location 312 of the housing 310, which provides a space or gap 324 equal to $D_2-D_1$. The seal body 340 includes a weak section 370 about the seal elements 360*a*, 360*b*, which in one embodiment will break when a selected expansion force is applied to the inside 344 of the seal body 340, and in another embodiment will radially expand but not break and will contract or retract substantially or fully to its original state when the expansion force is removed. The expansion force may be applied by any suitable mechanism, including, but not limited to, by a swaging tool.

Figure 3B:
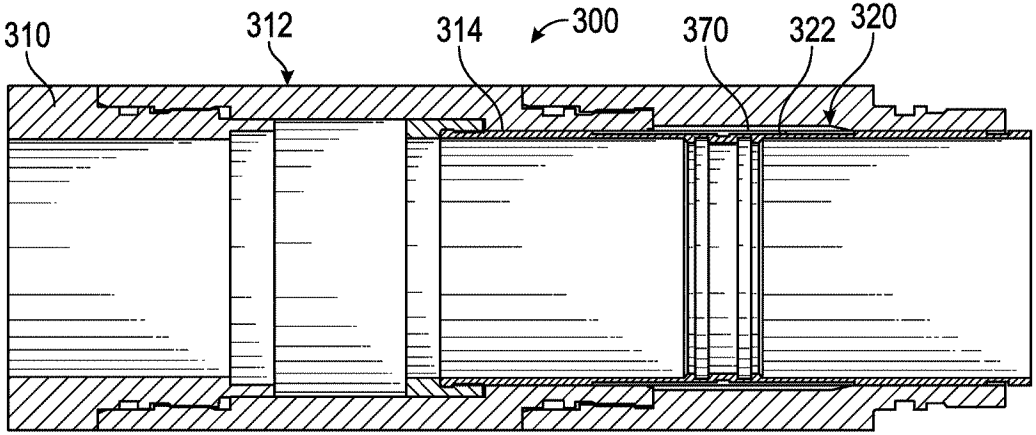
FIG. 3B is the isometric view of FIG. 3A after the expandable seal has been moved from the initial location in a string to an expansion location in the string.

FIG. 3B is the isometric view of FIG. 3A after the seal body 340 has been moved from the initial location 312 to the expansion location 320 at which location, a space 322 exists between the weak section 370 of the seal body 340 and the inside 314 of the housing 310. In this position, the seal body 340, in one embodiment may be permanently expanded by breaking the seal body 340 about the weak section 370 or in another embodiment retractably expanded, as described in reference to FIGS. 2A-2C.

Figure 4:
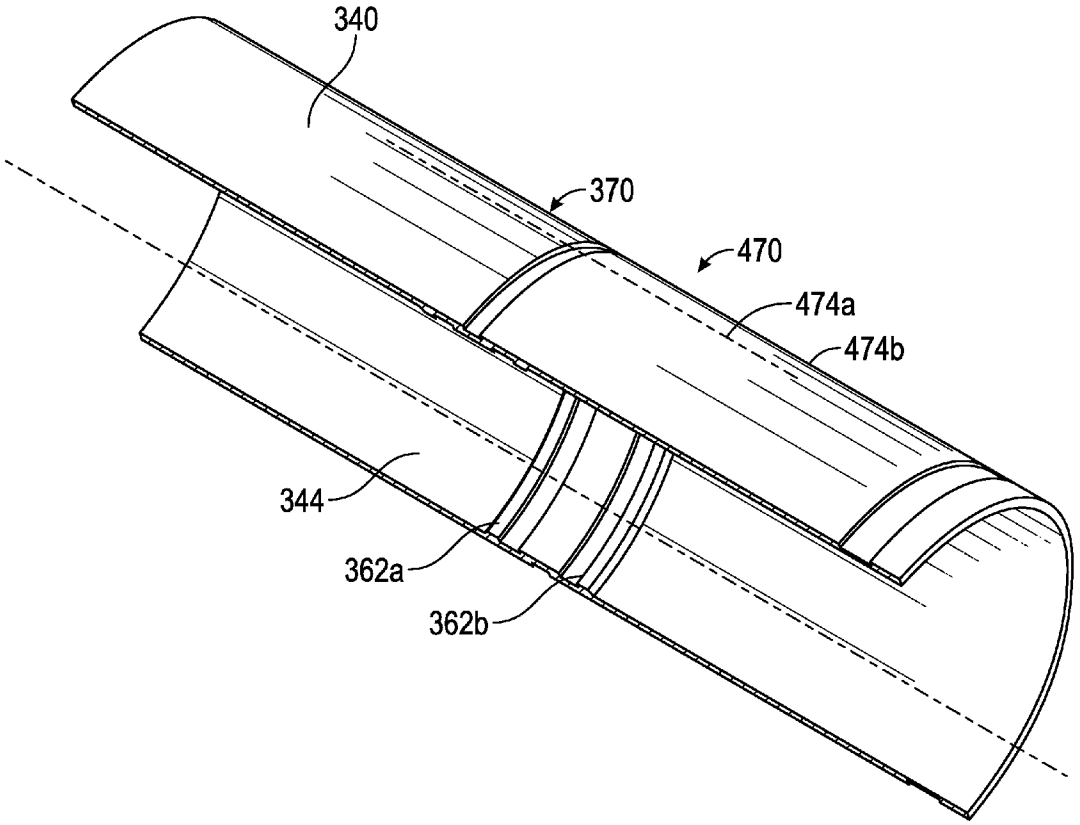
FIG. 4 is an isometric section view of a seal body depicting a weak section about which the expandable seal may be expanded in the expansion location shown in FIG. 3B.

FIG. 4 shows an isometric section view of the seal body 340 of FIG. 3A that includes a weak section 370 thereon. The seal body includes grooves 362*a*, 362*b*, etc. around its inside surface 344 for housing seal elements 360*a*, 360*b*, etc., (FIG. 3A). The weak section 370 may include any desired pattern 472 that will enable the seal body 340 to break about the pattern 472 and permanently expand when a selected or predetermined force is applied to the inside 344 of the seal body 340, as described in reference to FIGS. 2A-2C. In the particular embodiment of seal body 340 in FIG. 4, the weak section 370 is shown to include a number radially spaced axial grooves or scribe lines 474*a*, 474*b*, etc. However, any other suitable pattern may be utilized for the purpose of this disclosure, including, but not limited to, criss-cross lines, holes, and slots. Alternatively, at least the weak section 370 may be made of a suitable flexible or malleable material that will enable the seal body 340 to radially expand about the weak section upon the application of a selected internal force and cause it to retract when such force is removed.

Thus, is various aspects, the disclosure provides a downhole tool or string that may include one or more inverted seals, wherein the inverted seals may include an elongated member or body with one or more seal elements disposed along the interior surface of the elongated member. The seal elements may be made from an elastomeric material, non-elastomeric material, a metal, an alloy or a combination thereof. The elastomeric seals may be bonded the elongated member. The elongated member includes a weak section about the seal elements, which may include one or more stress concentration grooves, scribe lines, perforations or any other suitable pattern that will enable the elongated member to break when a force from the inside of the elongated member is applied to the weak section or it may be made from a material that will expand without breaking when the force from the inside is applied to the weak section and will contract or retract to its original shape or substantially the original shape when the force is removed. In downhole tool applications, the outer sealing surface of the elongated member is mated with a sealing surface, such as inside surface of a housing, at an initial or run-in location from where the elongated member can be moved upon application of a selected force onto the elongated member. Thus, the elongated member is slidably and sealingly placed at the initial location inside the housing. The inverted seal at the initial location is active, in that the seal elements engage with a tubular of appropriate outer dimension placed against the seal elements. The housing further includes an expansion section that has an internal diameter larger than the internal diameter at the initial location. To deactivate the seals, the elongated member or a supporting member associated with the elongated member is shifted axially to position the elongated member and the weak section in the expansion section. The elongated member is expanded, such as by a swage tool, to create sufficient stress on the inside of the elongated member to initiate a fracture and split or break the elongated member about the seal elements. The elongated member may split or break at least at one place at the stress concentration points, such as grooves or scribe lines. The elongated member when split along one or more stress concentration grooves or scribe lines will resemble a double or multiple ended collet. In this configuration, tools with outside diameter larger than the internal diameter of the seal elements are able to pass through the seals. Alternatively, when the elongated member is made from a malleable or expandable material, a tool may be configured to cause the elongated member to expand inside the expansion location of the housing to allow such tool to pass through the elongated member with the inverted seal elements.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. Apparatus for use in a wellbore, comprising:

a housing including a first location having a first inside dimension and a second location having a second inside dimension that is larger than the first inside dimension; and a seal assembly placed with a sliding fit at the first location, wherein the seal assembly includes a seal body and an inverted seal along an inside of the seal body, the seal body having a weak section at a location of the inverted seals, and wherein the seal assembly is movable from the first location to the second location to center the weak section over the second section, wherein the weak section is expandable into the second location when the seal assembly is positioned at the second location.

2. The apparatus of claim 1, wherein the weak section of the seal body includes a fracture location about which the seal body breaks and permanently expands into the second location when an outward force is applied to an inside of the seal body.

3. The apparatus of claim 1, wherein the weak section of the seal body temporarily expands into the second location when an outward force is applied to an inside of the seal body.

4. The apparatus of claim 3, wherein the weak section of the seal body is made from a malleable material.

5. The apparatus of claim 1, wherein expanding the weak section of the seal body into the second location provides an inside dimension in the housing that is larger than inside dimension before the expanding of the seal body.

6. The apparatus of claim 1, wherein the seal body includes a shifting profile for enabling a tool to engage therewith to move the seal assembly from the first location to the second location.

7. The apparatus of claim 1, wherein the seal body is configured to allow a common tool to move the seal body from the first location to the second location and expand the seal body into the second location.

8. The apparatus of claim 1 further comprising a string deployed in the wellbore and wherein the seal assembly is attached to an inside of the string.

9. The apparatus of claim 8, wherein the string includes at least one of: a packer; a sand screen; and at least one valve that allows a fluid to pass from an inside of the string to an outside of the string.

10. The apparatus of claim 9, wherein the string is configured for performing an operation in the wellbore that is selected from a group consisting of: fracturing; gravel packing; setting a packer between the string and the wellbore; and producing a fluid from a zone in the wellbore.

11. The apparatus of claim 1, wherein the weak section is on an outer diameter surface of the seal body.

12. A method of providing an apparatus in a wellbore, the method comprising:

conveying a string in the wellbore that includes a housing that includes a first location having a first inside dimension and a second location having a second inside dimension that is greater than the first inside dimension; a seal assembly with a sliding fit at the first location inside the housing, wherein the seal assembly includes a seal body and an inverted seal along an inside of the seal body, the seal body having a weak section at a location of the inverted seals, and wherein the seal assembly is movable from the first location to the second location to center the weak section over the second section, wherein the weak section is expandable into the second location;

performing a selected operation in the wellbore with the seal assembly at the first location; and moving the seal assembly from the first location to the second location after performing the selected operation.

13. The method of claim 12 further comprising:

permanently expanding the seal body into the second location; and passing a tool through the permanently expanded seal to a location below the permanently expanded seal.

14. The method of claim 13, wherein permanently expanding the seal body into the second location causes the seal body to break and permanently expand the seal body into the second location to enable a tool of dimensions greater than inside of the seal body before the break to pass through the seal assembly.

15. The method of claim 14, wherein moving the seal assembly from the first location to the second location comprises: engaging a tool with a profile on the seal assembly and applying a force onto to the seal assembly to move the seal assembly from the first location to the second location.

16. The method of claim 14, wherein the seal assembly is attached uphole of a port in the string.

17. The method of claim 14, wherein the string further comprises at least one of: a packer; a sand screen; and at least one valve that allows a fluid to pass from an inside of the string to an outside of the string.

18. The method of claim 12 further comprising:

temporarily expanding the seal body into the second location using a radially outward force from inside of the seal body; and passing a tool through the expanded seal body to a location below the seal assembly.

19. The method of claim 18, wherein the seal body retracts to its original position when the radially outward force is removed from the seal body.

20. The method of claim 12, wherein the selected operation is selected from a group consisting of: fracturing; gravel packing; setting a packer between the string and the wellbore; and producing a fluid from a zone in the wellbore.

* * * * *